US006681663B1

(12) United States Patent
Hsien

(10) Patent No.: US 6,681,663 B1
(45) Date of Patent: Jan. 27, 2004

(54) HAND TOOL HAVING A VIBRATION DEVICE

(76) Inventor: Chih-Ching Hsien, No. 367, Pei Yang Rd., Feng Yaun, Taichung (TW)

( * ) Notice: Subject to any disclaimer, the term of this patent is extended or adjusted under 35 U.S.C. 154(b) by 0 days.

(21) Appl. No.: 10/303,231

(22) Filed: Nov. 25, 2002

(51) Int. Cl.[7] ..... B25B 19/00
(52) U.S. Cl. ..... 81/463; 7/138; 81/464
(58) Field of Search ..... 81/463, 464; 7/138

(56) References Cited

U.S. PATENT DOCUMENTS 3,861,250 A * 1/1975 Zugai ..... 81/464
4,771,661 A * 9/1988 Levchenko et al. ..... 81/463
4,958,541 A * 9/1990 Annis et al. ..... 81/479

* cited by examiner

*Primary Examiner*—D. S. Meislin
(74) *Attorney, Agent, or Firm*—Charles E. Baxley

(57) ABSTRACT

A hand tool includes a function end such as an box end at one end of the handle and a vibration device is connected to the other end of the handle. The vibration device includes a tubular hollow body for receiving a power supply unit, a driving unit and a control switch therein. An eccentric member extends from an end of the driving unit such that when the driving unit is activated, the rotation of the eccentric member shakes the whole handle of the tool. A contact head is connected to an end of the body and protrudes from an outer periphery of the handle so that the rusted nut can be shaken by the contact head to loose the rust on the nut.

2 Claims, 5 Drawing Sheets

HAND TOOL HAVING A VIBRATION DEVICE

FIELD OF THE INVENTION

The present invention relates to a hand tool having a vibration device that is connected to an end of the handle of the tool and generates vibration to loosen the rust on the nuts or the like.

BACKGROUND OF THE INVENTION

A conventional hand tool such as a wrench generally includes a handle and a function end such as an open end of a box end is connected to an end of the handle. The user mounts the open end or the box end onto a nut and then rotates the handle to loosen or tighten the nut. Nevertheless, the nut could be rusted on a threaded rod so that it is difficult to rotate the nut relative the threaded rod. In order to loosen the rust on the nut and the threaded rod, the user hammers or hits the threaded rod or the nut by the tool or a hammer. After the rust is loosened, the nut can be easily to be rotated. When hammering the threaded rod or the nut, the force could be too large so that the threaded rod is deformed or the threads are damaged. This is a result that the users do not like to see.

The present invention intends to provide a hand tool that has a vibration device having a contact head which vibrates to loosen the rust so that the nut can be rotated by the wrench.

SUMMARY OF THE INVENTION

In accordance with one aspect of the present invention, there is provided a combination of a hand tool and a vibration device, wherein the tool comprises a handle having a function end for mounting to a polygonal object. A recess is defined in the handle so as to receive the vibration device which includes a tubular hollow body in which a power supply unit, a driving unit and a control switch are respectively received therein. An eccentric member extends from an end of the driving unit. A contact head is connected to an end of the body and protrudes from an outer periphery of the handle. The driving unit is powered and activated by the power supply unit and a rotation of the eccentric member shakes the whole handle including the contact head.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
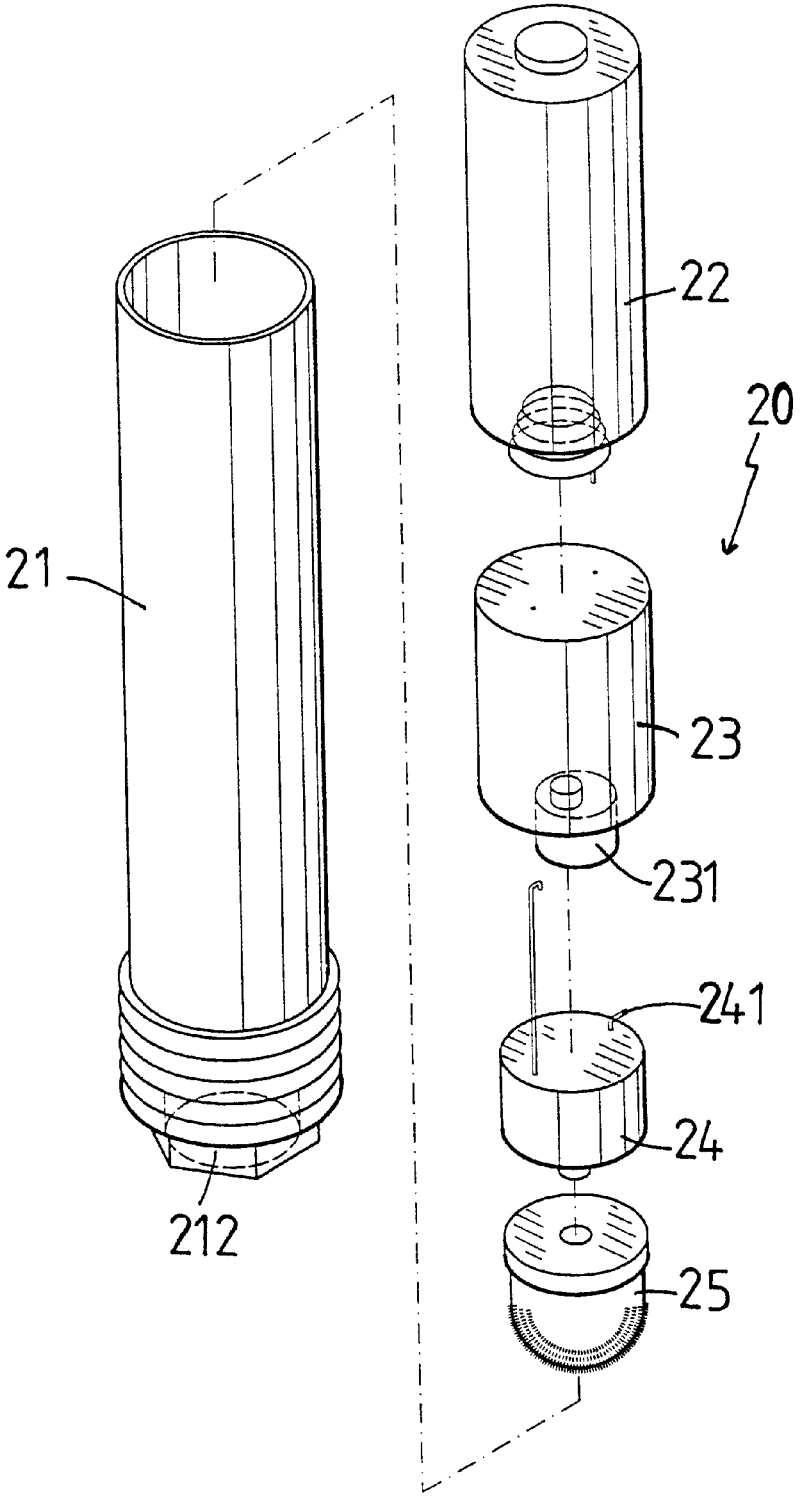
FIG. 1 is an exploded view to show the vibration device of the present invention.
Figure 2:
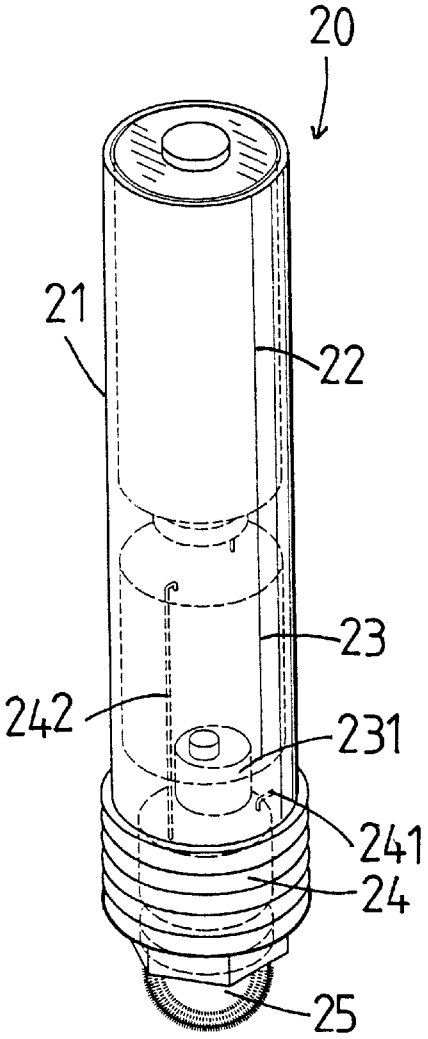
FIG. 2 is a perspective view to show the vibration device of the present invention.
Figure 4:
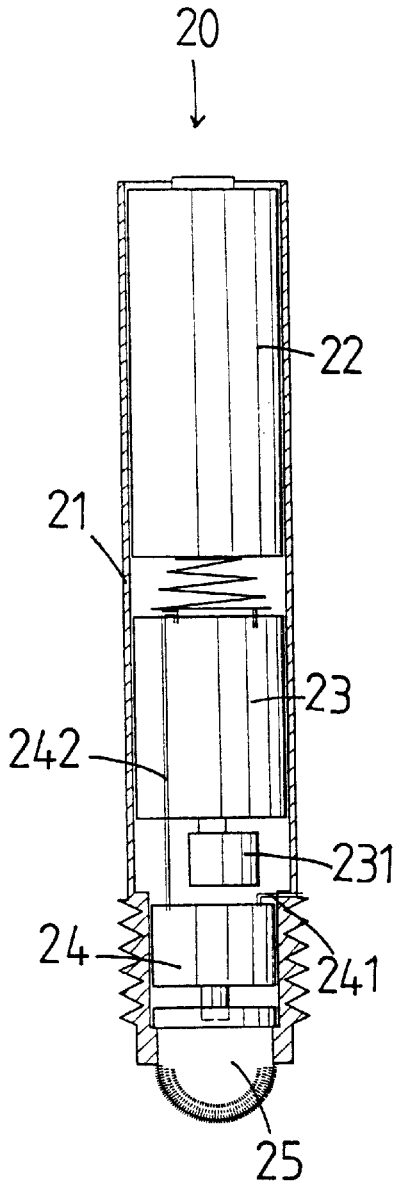
FIG. 4 shows a cross sectional view of the vibration device of the present invention.
Figure 3:
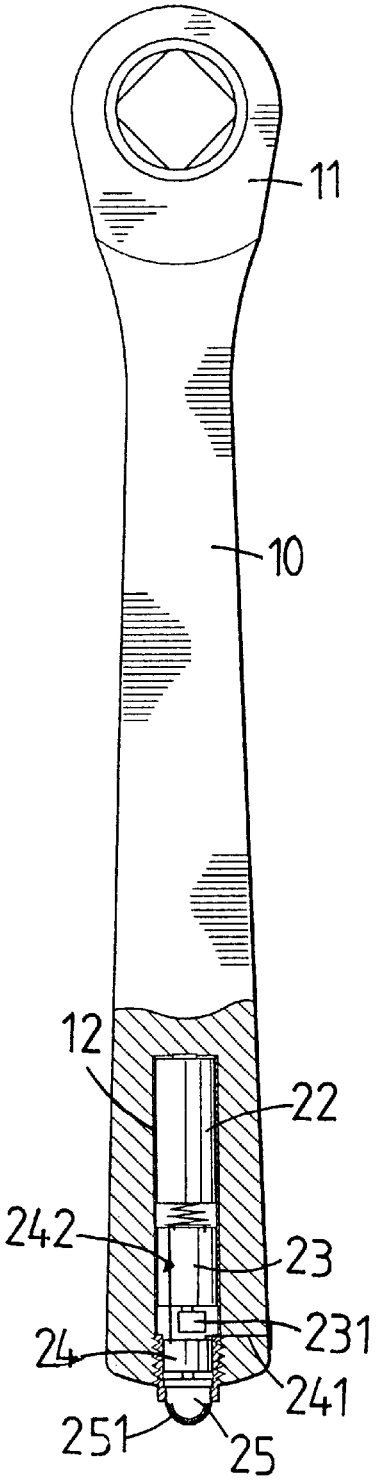
FIG. 3 shows the vibration device of the present invention is connected to an end of the handle of the tool.

Referring to FIGS. 1 to 4, the handle 10 of a hand tool includes a function end 11 such as a box end and a recess 12 is defined in an end of the handle 10 for receiving the vibration device 20 of the present invention therein.

The vibration device 20 comprises a tubular hollow body 21 which is received in the recess 12 and a power supply unit 22, a driving unit 23 and a control switch 24 are respectively received therein. An eccentric member 231 extends from an end of the driving unit 23 and a contact head 25 is connected to an open end 212 of the body 21 and protrudes from an outer periphery of the handle 10. The control switch 24 has two lines 241, 242 which are respectively in contact to the power supply unit 22 and the body 21. The driving unit 23 is powered and activated by the power supply unit 22 and a rotation of the eccentric member 231 shakes the whole handle 10 including the contact head 25. A serrated or rough surface 251 is mounted to the contact head 25 so as to provide enough friction for loosening the rust on a nut (both not shown).

Figure 5:
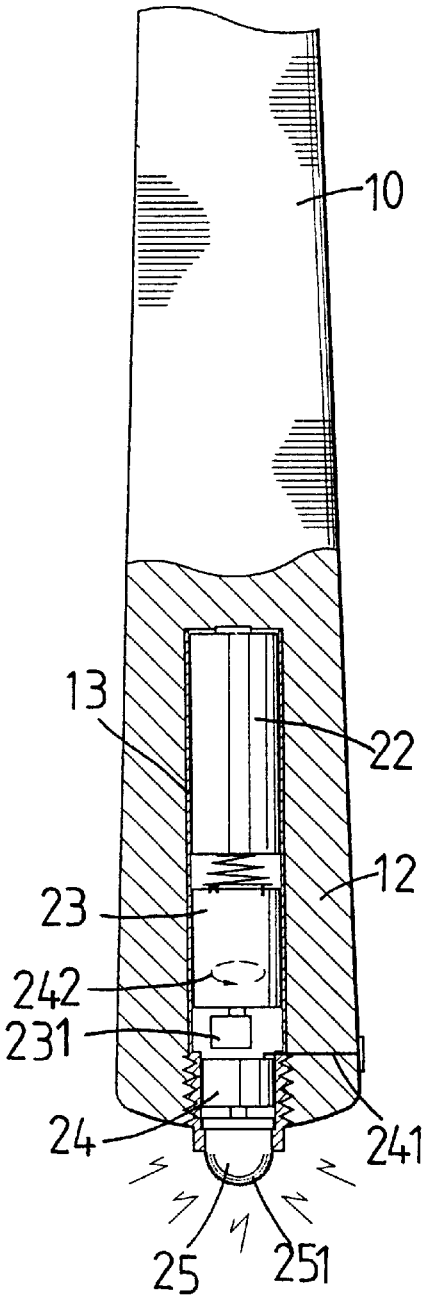
FIG. 5 shows the contact head is shaking.
Figure 6:
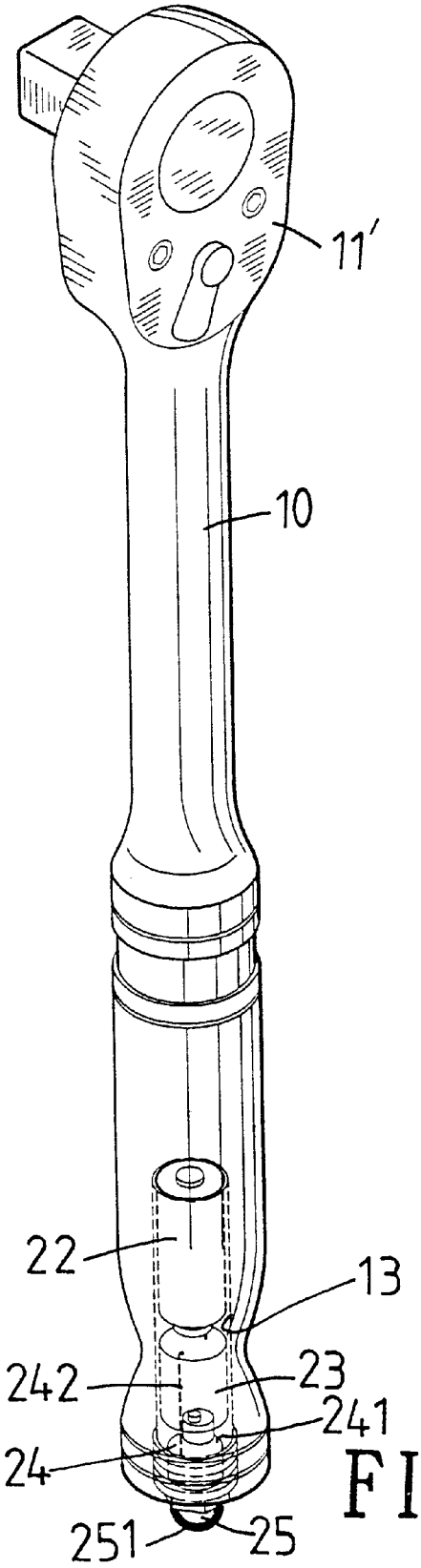
FIG. 6 is a perspective view to show a ratchet tool is cooperated with the vibration device of the present invention.

When using the vibration device 20, the contact head 25 is pushed against the rust on the nut and the control switch 24 is a push-type switch which is activated to activate the driving unit 23 to let the contact head 25 vibrate as shown in FIG. 5. After the rust is loosened, the box end 11 is easily to loosen the nut. As shown in FIG. 6, the vibration device 20 can also be cooperated with a ratchet tool that has a ratchet function end 11'.

Figure 7:
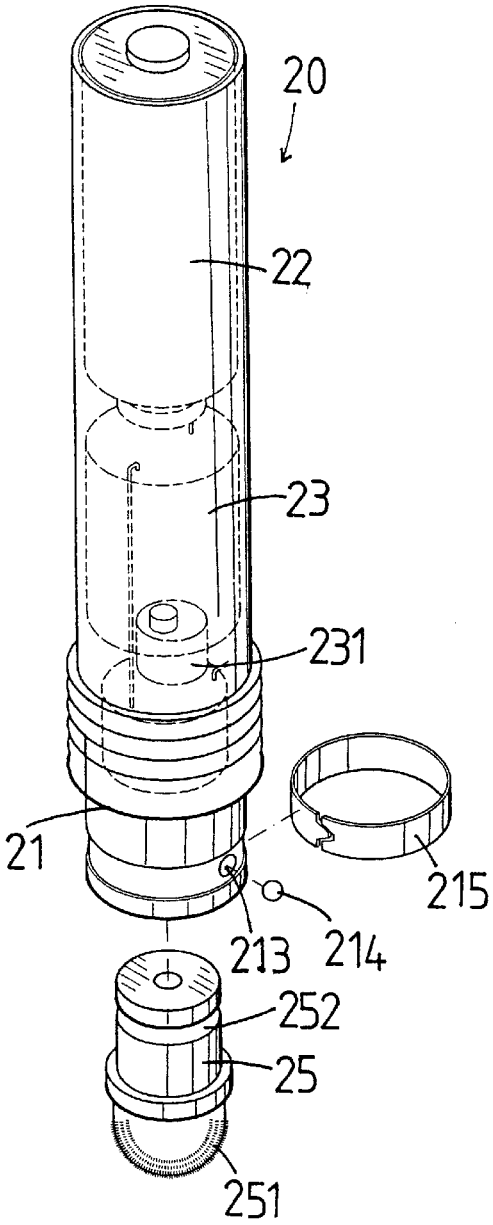
FIG. 7 is an exploded view to show another embodiment of the vibration device of the present invention.
Figure 8:
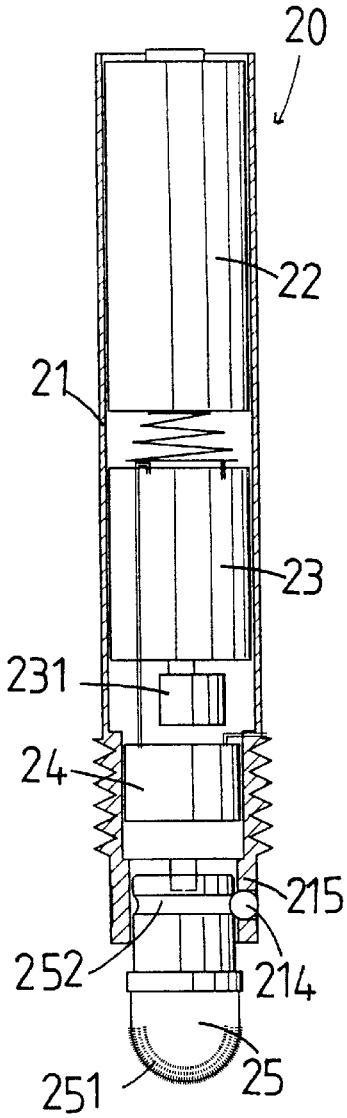
FIG. 8 is a cross sectional view to show the vibration device as shown in FIG. 7.

Referring to FIGS. 7 and 8, a hole 213 is defined through a wall of the body 21 and a bead 214 is received in the hole 213. A retaining ring 215 is mounted to the body 21 and seals the hole 213 to prevent the bead 214 from dropping from the hole 213. The contact head 25 has a groove 252 defined in a shank thereof and the bead 214 engaged with the groove 252. The contact head 25 can be conveniently inserted into or removed from the open end 212 of the body 21 by overcoming the urging force from the bead 214.

While we have shown and described the embodiment in accordance with the present invention, it should be clear to those skilled in the art that further embodiments may be made without departing from the scope of the present invention.

What is claimed is:

1. A combination of a hand tool and a vibration device, comprising:

a handle having a function end adapted to be mounted to a polygonal object and a recess defined in the handle so as to receive the vibration device, and the vibration device comprising a tubular hollow body and a power supply unit, a driving unit and a control switch respectively received therein, an eccentric member extending from an end of the driving unit and a contact head is connected to an end of the body and protruding from an outer periphery of the handle, the driving unit being powered and activated by the power supply unit and a rotation of the eccentric member shaking the whole handle including the contact head.

2. The combination as claimed in claim 1, wherein a hole defined through a wall of the body and a bead received in the hole, a retaining ring mounted to the body and sealing the hole to prevent the bead from dropping from the hole, the contact head having a groove defined in a shank thereof and the bead engaged with the groove.

* * * * *